US007371057B2

(12) United States Patent
Shin et al.

(10) Patent No.: US 7,371,057 B2
(45) Date of Patent: May 13, 2008

(54) VARIABLE CAPACITY SCROLL COMPRESSOR

(75) Inventors: Dong Koo Shin, Gyeonggi-do (KR); Hong Hee Park, Gyeongsangnam-do (KR); Cheol Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 771 days.

(21) Appl. No.: 10/832,427

(22) Filed: Apr. 27, 2004

(65) Prior Publication Data

US 2005/0019179 A1 Jan. 27, 2005

(30) Foreign Application Priority Data

Jul. 26, 2003 (KR) ..... 10-2003-0051771

(51) Int. Cl.
*F04C 18/04* (2006.01)

(52) U.S. Cl. ..... 417/440

(58) Field of Classification Search ..... 417/310, 417/440; 418/55.1

See application file for complete search history.

(56) References Cited

U.S. PATENT DOCUMENTS 4,431,388 A * 2/1984 Eber et al. ..... 417/440
5,496,160 A * 3/1996 Richardson et al. ..... 418/55.1
2003/0202886 A1 10/2003 Choi

FOREIGN PATENT DOCUMENTS

| | | |
|---|---|---|
| JP | 57-110789 | 7/1982 |
| JP | 5-180182 | 7/1993 |
| JP | 11-351167 | 12/1999 |
| KR | 1991-0002403 | 4/1989 |

OTHER PUBLICATIONS

English Language Abstract of JP 57-110789.
English Language Abstract of JP 11-351167.
English Language Abstract of JP 5-180182.

* cited by examiner

*Primary Examiner*—Michael Koczo, Jr.
(74) *Attorney, Agent, or Firm*—Greenblum & Bernstein, P.L.C.

(57) ABSTRACT

Disclosed is a variable capacity scroll compressor including a stationary scroll member on which a stationary spiral wrap is formed, an orbiting scroll member on which an orbiting spiral wrap is formed, the orbiting scroll member rotating while surface-contacting the stationary scroll, a driving motor, a driving shaft for rotating the orbiting scroll member using power transmitted from the driving motor, a control chamber formed on a predetermined portion of the stationary spiral wrap, a pivotal block disposed in the control chamber, and a controller for controlling a pivotal motion of the pivotal block.

20 Claims, 4 Drawing Sheets

VARIABLE CAPACITY SCROLL COMPRESSOR

BACKGROUND OF THE INVENTION

1. Field of the Invention

The present invention relates to a scroll compressor, and more particularly, to a variable capacity scroll compressor that is designed to vary a compression volume according to an operation mode of a system where it is applied.

2. Description of the Related Art

Generally, a cooling system is applied to an air conditioner or a refrigerator to lower the temperature of an enclosed space by absorbing and discharging heat using refrigerant circulating a cooling cycle.

Such a cooling system is configured to perform a series of cycles of compression, condensation, expansion and vaporization of refrigerant. A scroll compressor is used to perform the compression cycle among the series of cycles.

Since the scroll compressor is disclosed in a plurality of published documents, the detailed description on the general structure and operation will be omitted herein.

The reason why the compression volume of a scroll compressor should be varied will be described hereinafter.

A scroll compressor for a specific use is generally selected by considering the most disadvantageous operation condition when forecasting its use environment, for instance, the greatest compression volume-requested condition (i.e., a heating operation of an air conditioner using heat pump).

However, it is general that the most disadvantageous condition does not nearly occur in an actual operation. In an actual operation of the compressor, a condition needing a small compression volume (ex. cooling operation of air conditioner) not the most disadvantageous condition exists too.

Thus, when the compressor having a large compression volume is selected considering the worst condition, the compressor is operated under the low-load condition during an operation period of the high-compression ratio, thereby deteriorating an overall operation efficiency of the system.

Therefore, in order to improve the overall operating efficiency even under a normal operating condition and to accept the operational condition under the most disadvantageous condition, there is a need for a compressor that has a variable compression volume.

To vary the compression volume of the scroll compressor, a method for electrically controlling an RPM of the compressor has been most widely used.

Such an electrical control method has an advantage of effectively varying the compression volume. However, additional components, for instance, an inverter for accurately controlling the RPM of a motor, are required. Furthermore, when the motor rotates with a relatively high RPM, it is difficult to ensure a reliability of frictional portions.

SUMMARY OF THE INVENTION

Accordingly, the present invention is directed to a variable capacity scroll compressor that substantially obviates one or more problems due to limitations and disadvantages of the related art.

An object of the present invention is to provide a variable capacity scroll compressor that can vary a compression volume using a bypass function in a state where a compressor motor rotates at a constant RPM.

Another object of the present invention is to provide a variable capacity scroll compressor that can vary a compression volume by operating a valve using either uncompressed low-pressure fluid or compressed high-pressure fluid.

Another object of the present invention is to provide a variable capacity scroll compressor that can vary a compression volume using a simple structure.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a variable capacity scroll compressor including: a stationary scroll member provided with a stationary spiral wrap; an orbiting scroll member provided with an orbiting spiral wrap, the orbiting spiral wrap orbiting while surface-contacting the stationary spiral wrap; a driving motor; a driving shaft for rotating the orbiting scroll member using power transmitted from the driving motor; a control chamber formed on a predetermined portion of the stationary spiral wrap; a pivotal block disposed in the control chamber; and a controller for controlling a position of the pivotal block.

In another aspect of the present invention, a variable capacity scroll compressor including: a stationary scroll member; an orbiting scroll member orbiting while surface-contacting the stationary scroll; a driving motor and a driving shaft for providing a rotational force to the orbiting scroll member; a control chamber formed on a compression path of the scroll member; a pivotal block disposed in the control chamber and coupled with the control chamber by a hinge; and a bypass controller for allowing pressure of an exhaust passage exhausted at least from the compressor to be selectively applied to the control chamber to control a pressure state of the control chamber.

In a further aspect of the present invention, a variable capacity scroll compressor including: a control chamber formed on a compression path of a scroll member; a pivotal block pivotally fixed by a hinge and disposed in the control chamber to control a bypass of fluid being compressed; a controller for controlling a pivotal motion of the pivotal block.

According to the present invention, the compression volume of the scroll compressor can be easily varied without adding additional components.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
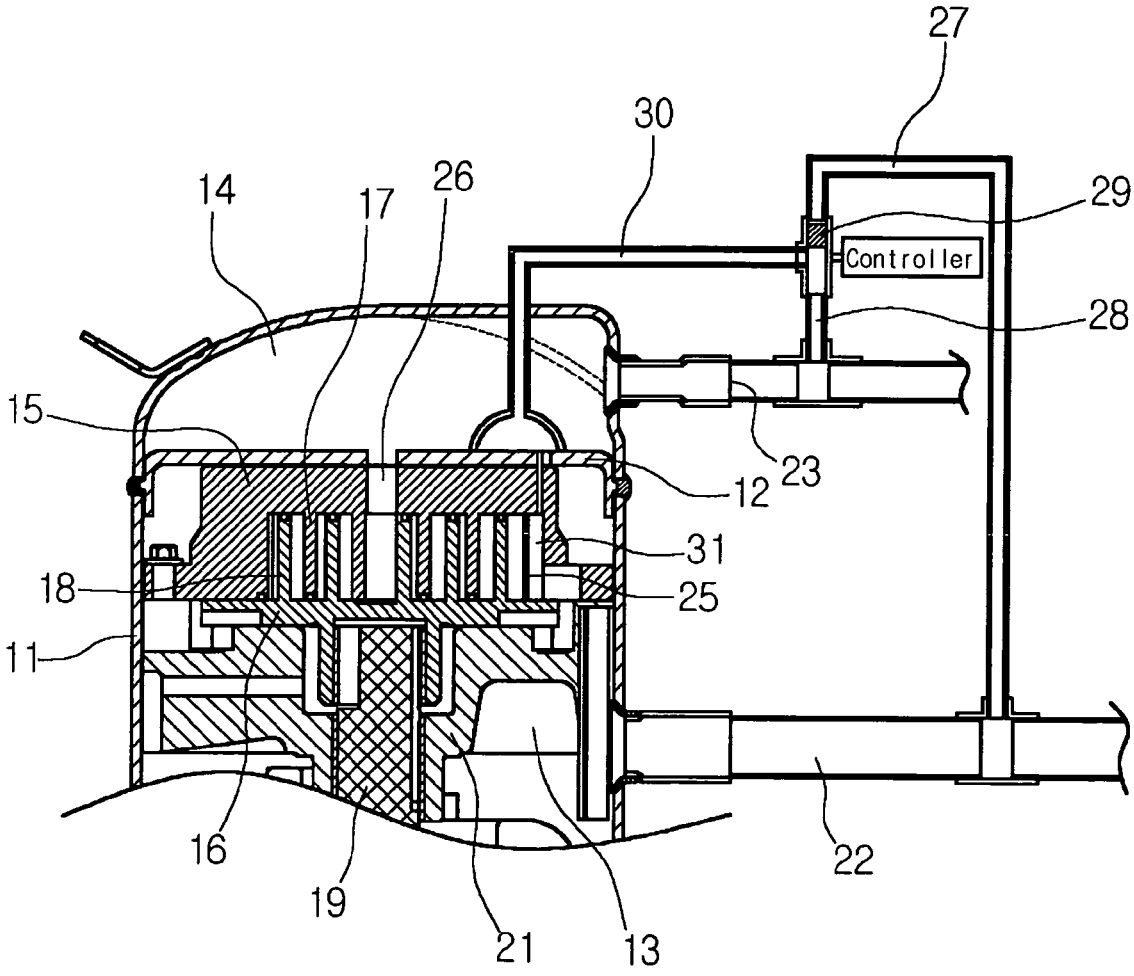
FIG. 1 is a sectional view of a scroll compressor according to a first embodiment of the present invention.

FIG. 1 shows a sectional view of a scroll compressor according to an embodiment of the present invention.

Referring to FIG. 1, the inventive variable capacity scroll compressor includes a conventional compressing part, a bypass part for varying a compression volume, and a bypass control part for controlling the bypass part.

The conventional compressing part includes a seal case 11 for defining an enclosed chamber, a seal plate 12 disposed in the seal case 11 to divide the enclosed chamber into a low-pressure intake chamber 13 and a high-pressure exhaust chamber 14, an intake passage 22 connected to the intake chamber 13 to supply fluid to be compressed to the intake chamber 13, an exhaust passage 23 connected to the exhaust chamber 14 to exhaust compressed fluid out of the exhaust chamber 14, a stationary scroll member 15 fixed on an inner circumference of the seal case 11, a driving shaft 19 extending from a motor (not shown), an orbiting scroll member 16 associated with an eccentric pin 20, a stationary spiral wrap 17 formed on the stationary scroll member 15, an orbiting spiral wrap 18 defining the fluid compressing path by intermittently surface-contacting the stationary spiral wrap 17, a bearing 21 for stably supporting the driving shaft 19, and a central exhaust passage 26 formed through a central axis of the stationary scroll member 15 to direct the compressed fluid to the exhaust chamber 14.

The bypass part includes a control chamber 31 defined by cutting away a portion of an outer inside-wall of the stationary spiral wrap 17 and a pivotal block 25 reciprocally disposed in the control chamber 31 to selectively close the fluid compressing path. An end of the pivotal block 25 is pivotally fixed on a hinge 43 (see FIG. 3) formed on a portion of the stationary spiral wrap 17.

The pivotal block 25 is designed having an inner surface identical to a wall defining the compressing space so that the fluid can be effectively compressed.

The bypass control part includes a control passage 30 connected to the control chamber 31 to control fluid pressure applied to the control chamber 31 and a control valve 29 for allowing the control pressure formed on the control passage 30 to be selectively supplied from one of the low-pressure and high-pressure passages 27 and 28. The control passage 30 is formed penetrating the seal plate 12 to communicate with a compressing space of the conventional compressing part.

Particularly, the low-pressure passage 27 has a first end connected to the control valve 29 and a second end connected to the intake passage 22 so that high-pressure of the intake passage 22 can be applied to the low-pressure passage 27. The high-pressure passage 27 has a first end connected to the control valve 29 and a second end connected to the exhaust passage 23 so that low-pressure of the exhaust passage 23 can be applied to the high-pressure passage 28.

The control valve 29 can be formed of a solenoid valve controlled by a predetermined controller. The control passage is connected to the seal plate 12 through the seal case 11, indicating a series of passages penetrating the stationary scroll member 15. However, the present invention is not limited to this structure. That is, any passages connecting the control valve 29 and the control chamber 31 will be possible. For example, even if a passage is directly connected to the control chamber 31 without passing through the seal plate 12, it will not affect in realizing the present invention.

The operation of the above described variable capacity scroll compressor will be described hereinafter.

When the driving shaft 19 and the eccentric pin 20 are rotated by the motor (not shown), the orbiting scroll member 16 associated with the eccentric pin 19 orbits. At this point, the stationary scroll member 15 is in a fixed state.

When the orbiting scroll member 16 rotates, low-pressure fluid stored in the intake chamber 13 is directed into a space defined between the orbiting spiral wrap 18 formed on the orbiting scroll member 16 and the stationary spiral wrap 17 formed on the stationary scroll member 15, and is then compressed in the space.

The compressed fluid is directed into the exhaust chamber 14 through the central exhaust passage 26 formed through the central axis of the stationary scroll member 15, and the high-pressure fluid in the exhaust chamber 14 is exhausted through the exhaust passage 23.

Meanwhile, the pivotal block 25 and the control chamber 31 are provided for the bypass purpose. When the pivotal block 25 is pivoted in a direction to surface-contact the orbiting spiral wrap 18 and to form a normal compression path, the fluid is compressed. However, when the pivotal block 25 is pivoted in an opposite direction to form an abnormal compression path, since the fluid being compressed is bypassed through a gap defined between the pivotal block 25 and the orbiting spiral wrap 18, the compression is not realized. As describe above, the compression volume is varied in accordance with the orbiting operation of the pivotal block 25.

In other words, when the pivotal block 25 pivots in a direction where the pivotal block 25 is not in surface-contact with the orbiting spiral wrap 18, the compression volume is reduced.

Meanwhile, in order to control the operation of the pivotal block 25, the control valve 29, a downstream end of which is connected to the control chamber 31, is provided to apply control pressure to the control chamber 31. Formed on an upstream end of the control passage 30 is the control valve 29.

By the control valve 29, one of the fluid pressures from the low-pressure and high-pressure passages 27 and 28 is selected and applied to the control passage 30.

Particularly, the low-pressure and high-pressure passages 27 and 28 are respectively connected to the intake and exhaust passages 22 and 23 such that low-pressure fluid that is not compressed in the conventional compressing part and high-pressure fluid that is compressed in the conventional compressing part can be respectively supplied to the low-pressure and high-pressure passages 27 and 28.

In detail, when the high-pressure passage 28 is connected to the control passage 30 by the control valve 29 moved upward in FIG. 1, since the control passage 30 is supplied with the high-pressure, the pivotal block 25 is pushed leftward in the drawing. At this point, since the movable block 25 surface-contacts the orbiting spiral wrap 18, the fluid can be compressed even at a location where the pivotal block 25 is located during the orbiting movement of the orbiting spiral wrap 18. That is, the pivotal block 25 is not completely bent even when high pressure is applied, but is moved up to a location where the wall for defining a compression space can be formed. Therefore, the displacement of the pivotal block 25 can be limited by forming a predetermined stopper structure 100. To realize this, a stepped surface opposing the hinge 43 is formed on a predetermined wall defining the compression space. By this structure, when the pivotal block 25 is pivoted by high-pressure, the pivotal block 25 is caught by the stepped portion so that it cannot be pivoted above a predetermined angle.

Meanwhile, when high-pressure is applied to the control chamber 31, a seal member (not shown) may be further formed between the pivotal block 25 and the stationary spiral wrap 17 to prevent the high-pressure fluid from leaking. By this structure, the moving direction and location setting can be reliably realized.

However, when the low-pressure passage 27 is connected to the control passage 30 by the control valve 29 moving downward in FIG. 1, since low-pressure is applied to both the control passage 30 and the control chamber 31, the pivotal block 25 is displaced rightwards in FIG. 1. That is, a rotational direction of the pivotal block 25 is designed to be controlled by the pressure of the control chamber 31 and by a medium pressure of fluid being compressed in the conventional compressing part. Therefore, since the medium pressure is greater than pressure of the low-pressure passage 27, which is pressure of an intake side of the compressing part, the pivotal block moves rightwards.

Thus, when the pivotal block 25 is opened by being moved rightwards, since a predetermined gap is formed between the orbiting spiral wrap 18 and the pivotal block 25, the fluid being compressed is bypassed through the gap. As a result, the compression volume is reduced. In this case, the compression volume is reduced by as much as an amount of fluid bypassed.

Figure 2:
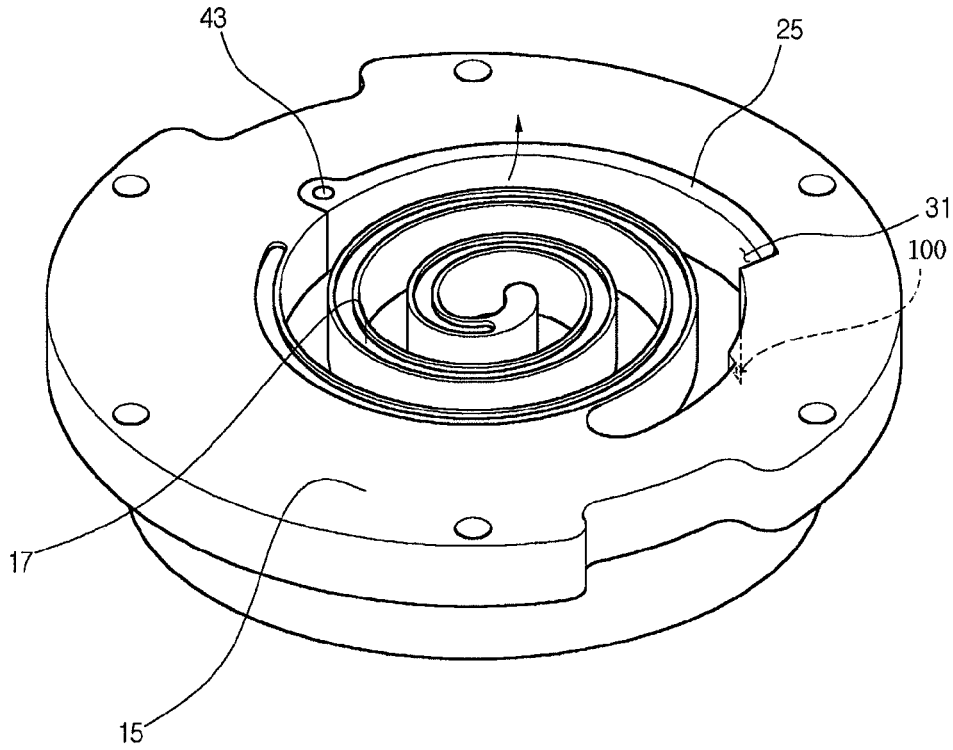
FIGS. 2 and 4 and are bottom views of a stationary scroll member depicted in FIG. 1.
Figure 4:
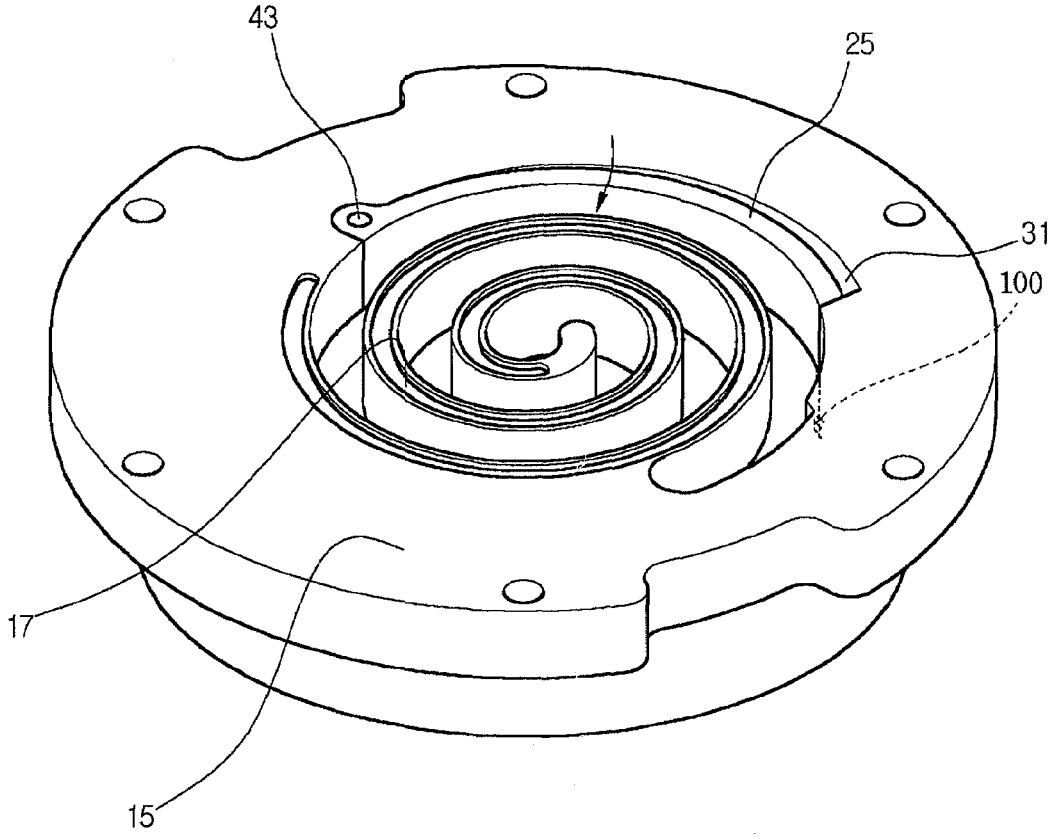

FIGS. 2 and 4 show bottoms views of the stationary scroll member of the present invention.

Particularly, FIG. 2 shows the pivotal block 25 that is displaced clockwise (in an arrow direction of FIG. 2. Since FIG. 2 is a bottom view of the stationary scroll member, the arrow direction indicates a counterclockwise direction). That is, FIG. 2 shows a state where the compression volume is reduced. FIG. 4 shows the pivotal block 25 that is displaced counterclockwise (in an arrow direction of FIG. 4. Since FIG. 4 is a bottom view of the stationary scroll member, the arrow direction indicates a clockwise direction). That is, FIG. 2 shows a state where the compression volume is normal.

Referring to FIGS. 2 and 4, the stationary spiral wrap 17 is formed on the stationary scroll member 15, and the control chamber 31 is defined by cutting away of a portion of the outer inside-wall of the stationary spiral wrap 17. The pivotal block 25 is pivotally fixed on the hinge 43 formed on a portion of the stationary spiral wrap 17.

The pivotal block 25 may be disposed on the outermost of the spiral wrap 17 (i.e., the closest location to the intake side of fluid. By this structure, fluid compressed above predetermined pressure is not bypassed on a fluid compressing path, thereby reducing output loss of the motor.

In addition, the hinge 43 may be formed on a portion of the pivotal block 25, which is farthest from the intake side of the compressing part. By this structure, the greater the distance between the gap defined between the pivotal block 25 and the orbiting spiral wrap 18 and the intake side, the smaller the output loss of the motor.

In detail, when the high-pressure is applied to the control chamber 31, the seal between the pivotal block 25 and the orbiting spiral wrap 18 may not be perfectly realized even if the pivotal block 25 pivots rightwards (see the arrow direction of FIG. 4). However, when the hinge is formed as proposed above, even if there is a gap between the pivotal block 25 and the orbiting spiral wrap 18, the gap is completely removed to allow for the fluid compression. As a result, the output loss can be reduced.

If the hinge 43 is located close to the intake side of the compressing part and the location control of the pivotal block 25 is not perfectly realized, since the fluid compressed by the operation of the orbiting spiral wrap 18 is bypassed, the motor creates useless output.

In addition, since the fluid pressure is increased as it goes inward of the spiral wraps 17 and 18, it is preferable that the hinge 43 is formed on an inner side of the pivotal block 25 to stably support the pivotal block 25 at high-pressure.

Hereinbelow, operation of the variable capacity scroll compressor of the present invention will be described.

Figure 3:
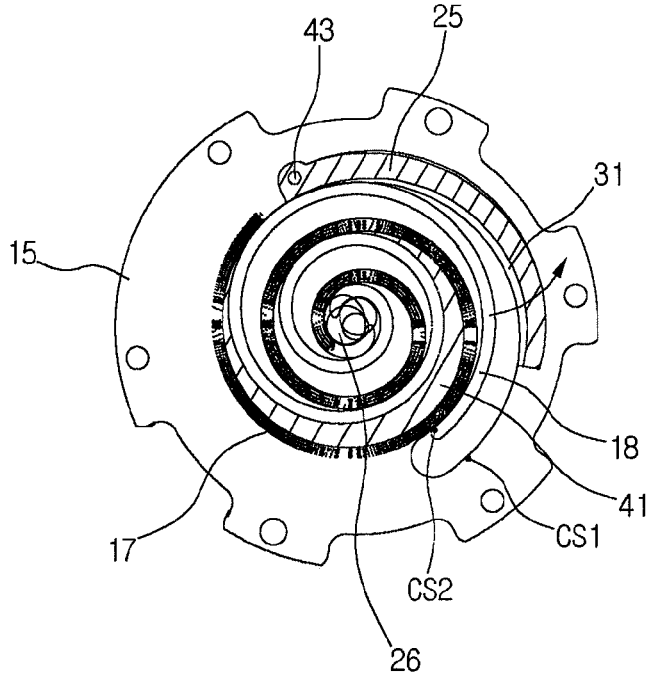
FIGS. 3 and 5 are views conceptually illustrating a compression volume variation in accordance with a displacing state of an operational block according to the present invention.
Figure 5:
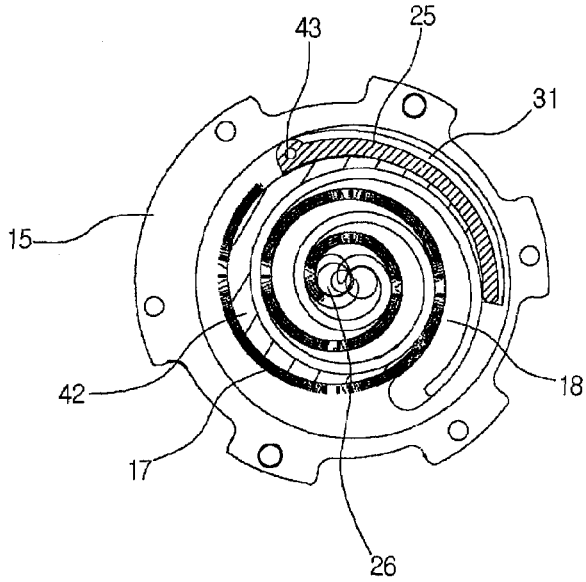
Figure 6:
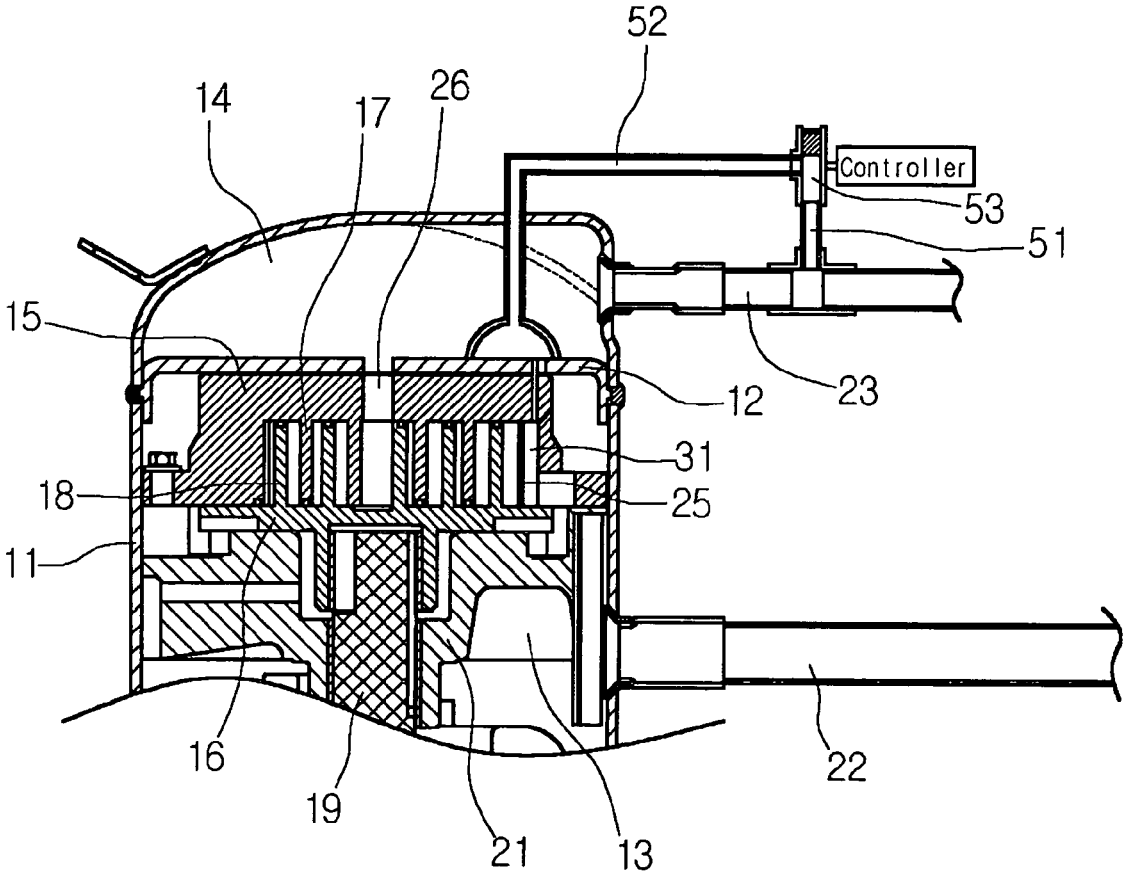
FIG. 6 is a sectional view of a scroll compressor according to a second embodiment of the present invention.

FIGS. 3 and 5 conceptually illustrate a compression volume variation in accordance with a displacing state of an operational block according to the present invention.

Particularly, FIG. 3 corresponds to a state depicted in FIG. 2, illustrating a state where the pivotal block surface is separated from the orbiting scroll member, and FIG. 5 corresponds to a state depicted in FIG. 4, illustrating a state where the pivotal block 25 contacts the orbiting scroll member.

Referring first to FIG. 3, a space between the pivotal block 25 and the orbiting spiral wrap 18 is defined with a predetermined length, allowing the fluid being compressed to be exhausted. Since the control passage 30 and the control chamber 31 are applied with low-pressure of the intake side of the compressing part, the pivotal block 25 is designed to freely pivot by medium-pressure of the fluid being compressed.

In a state where the low-pressure is applied to the control chamber 31, a first intake volume 41 which is a compressing space defined between the stationary spiral wrap 17 and the orbiting spiral wrap 18 starts from a location where the stationary spiral wrap 17 contacts the orbiting spiral wrap 18 over the location where the pivotal block 25 is installed (the hinge 43 is formed). Therefore, the fluid being compressed is partly bypassed to reduce the compression volume.

The intake volume will be described more in detail hereinafter.

The intake volume defined between the stationary and orbiting spiral wraps 17 and 18 contacting each other may be divided into first and second volumes.

The first volume is a first intake space defined when an inner circumference of the stationary spiral wrap 17 meets an outer circumference of the orbiting spiral wrap 18. The first intake space can be illustrated as the first intake volume 41 depicted in FIG. 3.

The second volume is a second intake space (not shown) when an outer circumference of the stationary spiral wrap 17 meets an inner circumference of the orbiting spiral wrap 18. Although the second intake space is not shown in the drawing, it can be assumed that the second intake space can be formed by the orbiting operation of the orbiting spiral wrap 18.

A start point of the first intake space is defined on a location indicated by the reference character SC1 (Compress Start 1), and a start point of the second intake space is defined on a location indicated by the reference character SC2 (Compress Start 2. Since the start points SC1 and SC2 are not symmetrically located, this can be called an asymmetry operation mode. That is, when the scroll member is divided into two halves based on the central portion of the scroll member and both the start points SC1 and SC2 are sided to one half, this can be called the asymmetric operation mode.

Referring to FIG. 5, since there is no space between the pivotal block 25 and the stationary spiral wrap 17, the fluid being compressed cannot be bypassed. Since the control passage 30 and the control chamber 31 are applied with high-pressure of the exhaust side of the compressing part, the pivotal block 25 is designed not to pivot by medium-pressure of the fluid being compressed.

In a state where the high-pressure is applied to the control chamber 31, a second intake volume 42 which is a compressing space defined between the stationary spiral wrap 17 and the orbiting spiral wrap 18 starts from a location where the stationary spiral wrap 17 contacts the orbiting spiral wrap 18 at an intake side of the pivotal block 25.

As described above, the intake volume is varied in accordance with a variety of factors such as a connection state of the control valve 29, a pressure state of the control chamber 31 associated with the control valve 29, and a pivotal state of the pivotal block 25. That is, when the pivotal block 25 is separated from the orbiting spiral wrap 18, an initial compression space is identical to the first intake volume 41. When the pivotal block 25 surface-contacts the orbiting spiral wrap 18, the initial compression space is identical to second intake volume 42.

As shown in, the drawings, since the first intake volume 41 is less than the second intake volume 42. That is, when the second intake volume 42 is formed, the compression volume is increased. That is, the compression volume obtained when the pivotal block 25 pivots clockwise (see FIG. 5), when high-pressure is applied to the control chamber 31, when high-pressure is applied to the control passage 30, or when the control valve 29 is operated such that the exhaust passage of the compressing part is connected to the control passage 30 is greater than that when the cases are opposite states.

As a result, since there is a difference in a volume of fluid fed during an initial compressing operation of the scroll compressor, the compression volume can be varied by the volume difference of the intake space.

For example, when the control valve 29 is operated such that the high-pressure passage 28 is connected to the control passage 30, since the pivotal block 25 is pivoted clockwise so as fluid being compressed not to be bypassed. In this case, since the compression volume is increased to be suitable for an operational mode of the air conditioner where a relatively large compression volume is required.

When the control valve 29 is displaced such that the low-pressure passage 27 is connected o the control passage 30, the pivotal block 25 pivots counterclockwise (see FIG. 3) and the fluid being compressed is bypassed. In this case, since he compression volume is reduced to be suitable for an operational mode of the air conditioner where a relatively small amount of compression volume is required.

The application of the compressor of the present invention is not limited to the air conditioner that is used only for a description example. That is, the inventive compressor can be applied to any systems requiring a variable compression volume.

FIG. 7 shows a scroll compressor according to a second embodiment of the present invention.

As shown in the drawing, the scroll compressor of this embodiment is identical to that of the first embodiment except for a connection structure around the control valve.

That is, a control passage 52, a control valve 53, and a high-pressure passage 51 are same as those in the first embodiment. However, the low-pressure passage 27 that is selectively connected to the control passage 52 by the control valve 53 in the first embodiment is not formed in this embodiment.

When the low-pressure passage 27 is not formed, only the high-pressure is selectively applied to the control passage 52 in accordance with the operation of the control valve 53.

The operation of this embodiment will be described hereinafter.

The operation where the high-pressure is applied to the control chamber 31 by the control valve 53 displaced upward is identical to that of the first embodiment. However, when the control valve 53 is displaced downward so that no fluid pressure is applied to the control passage 52, since pressure of the control passage 52 is lower than medium-pressure of fluid being compressed in the compressing part, the pivotal block 25 rotates clockwise (see FIG. 3). That is, since a high-pressure state formed in the control passage 52 in the course of receiving the high-pressure is released through a gap formed on, for example, an outer circumference of the pivotal block 25, the high-pressure state is not maintained. However, in order to remove the high-pressure state formed in the control passage 52, a small hole may be formed on a juncture of the passages. In addition, even when a little amount of fluid is leaked, since there is no newly supplied high-pressure fluid, the operation of the pivotal block 25 can be perfectly controlled.

Therefore, the operation of the pivotal block 25 can be controlled even when there is no connection to the low-pressure passage 27 (see FIG. 1).

As described above, by simply controlling the control valve, it is possible to conveniently allow the fluid being compressed to be bypassed. Particularly, the mainspring of the control of the bypass port is to selectively use low-pressure formed by fluid that is not inhaled into the conventional compressing part and high-pressure formed by fluid compressed by the conventional compressing part.

Also, in the scroll compressor according to the present invention, it is possible to vary the compression volume in multi-stages using a bypass function, which can be realized by a simple structure, without varying the RPM of the compression motor.

In addition, since the valve for realizing the volume variation of the scroll compressor is designed to be controlled by fluid pressure that is not still compressed in the compressing part and fluid pressure that is compressed in the compressing part without adding additional components, the manufacturing cost of the scroll compressor can be saved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A variable capacity scroll compressor comprising:

a stationary scroll member provided with a stationary spiral wrap;

an orbiting scroll member provided with an orbiting spiral wrap, the orbiting spiral wrap orbiting while contacting the stationary spiral wrap;

a driving motor;

a driving shaft for orbiting the orbiting scroll member using power transmitted from the driving motor; a control chamber formed on a predetermined portion of the stationary spiral wrap; a pivotal block disposed in the control chamber; and a controller for controlling a position of the pivotal block.

2. The variable capacity scroll compressor according to claim 1, wherein the controller comprises a control valve for selectively directing one of low-pressure fluid in an intake passage and high-pressure fluid in an exhaust passage to the control chamber.

3. The variable capacity scroll compressor according to claim 1, wherein the control chamber is formed along an inner circumference of the stationary spiral wrap.

4. The variable capacity scroll compressor according to claim 1, wherein the pivotal block is hinge-coupled on an end portion of the stationary scroll member, the end portion opposing an intake terminal of the stationary scroll member.

5. The variable capacity scroll compressor according to claim 1, wherein the controller comprises:

a low-pressure passage connected to an intake passage which is connected to an intake chamber of the compressor;

a high-pressure passage connected to an exhaust passage which is connected to an exhaust chamber of the compressor;

a control passage connected to the control chamber; and a control valve for selectively directing one of low-pressure fluid from the low-pressure passage and high-pressure fluid from the high-pressure passage to the control passage.

6. The variable capacity scroll compressor according to claim 1, wherein the controller comprises a control valve for selectively directing to the control chamber high-pressure fluid of an exhaust passage which is connected to an exhaust chamber of the compressor.

7. The variable capacity scroll compressor according to claim 1, wherein the pivotal block has an inner circumference with a shape that is the same as that of an inner circumference of the stationary spiral wrap.

8. The variable capacity scroll compressor according to claim 1, wherein the controller is controlled by fluid pressure compressed in the scroll compressor.

9. The variable capacity scroll compressor according to claim 1, wherein a contact surface between the pivotal block and the stationary spiral wrap is sealed.

10. The variable capacity scroll compressor according to claim 1, further comprising a stopper for restricting a pivotal motion of the pivotal block.

11. A variable capacity scroll compressor comprising:

a stationary scroll member;

an orbiting scroll member orbiting while surface-contacting the stationary scroll;

a driving motor and a driving shaft for providing a rotational force to the orbiting scroll member;

a control chamber formed on a compression path of the stationary scroll member;

a pivotal block disposed in the control chamber and coupled with the control chamber by a hinge; and a bypass controller for allowing high-pressure fluid exhausted at least from the compressor to be selectively applied to the control chamber to control a pressure state of the control chamber.

12. The variable capacity scroll compressor according to claim 11, wherein the bypass controller comprises:

a control valve for selecting one of fluid pressure of an intake passage which is connected to an intake chamber of the compressor and fluid pressure of an exhaust passage which is connected to an exhaust chamber of the compressor; and a control passage having both ends respectively connected to the control valve and the control chamber and allowing fluid pressure selected by the control valve to be applied to the control chamber.

13. The variable capacity scroll compressor according to claim 11, wherein the bypass controller comprises:

a control valve for selectively passing fluid pressure of an exhaust passage which is connected to an exhaust chamber of the compressor; and a control passage having both ends respectively connected to the control valve and the control chamber and allowing fluid pressure passed through the control valve to be applied to the control chamber.

14. The variable capacity scroll compressor according to claim 11, wherein the control chamber is formed in a compression space of the stationary scroll member.

15. The variable capacity scroll compressor according to claim 11, wherein the control chamber is formed by depressing an outer circumference of the stationary scroll member by a predetermined length.

16. The variable capacity scroll compressor according to claim 11, wherein the pivotal block is designed to freely pivot around the hinge by fluid pressure.

17. The variable capacity scroll compressor according to claim 11, wherein a location of the pivotal block is controlled by the hinge pivotally fixing an end of the pivotal block.

18. A variable capacity scroll compressor comprising:

a stationary scroll member;

an orbiting scroll member orbiting while surface-contacting the stationary scroll;

a driving motor and a driving shaft for providing a rotational force to the orbiting scroll member;

a control chamber formed on a compression path of the stationary scroll member;

a pivotal block pivotally fixed by a hinge and disposed in the control chamber to control a bypass of fluid being compressed; and a controller for controlling a pivotal motion of the pivotal block.

19. The variable capacity scroll compressor according to claim 18, wherein the controller is designed to selectively supply fluid pressure of an intake fluid or exhaust fluid of the compressor.

20. The variable capacity scroll compressor according to claim 18, wherein the hinge is formed on a stationary scroll member.

* * * * *